US006890591B2

(12) United States Patent
Agarwal et al.

(10) Patent No.: US 6,890,591 B2
(45) **Date of Patent: *May 10, 2005**

(54) POLISHING PADS AND PLANARIZING MACHINES FOR MECHANICAL OR CHEMICAL-MECHANICAL PLANARIZATION OF MICROELECTRONIC-DEVICE SUBSTRATE ASSEMBLIES, AND METHODS FOR MAKING AND USING SUCH PADS AND MACHINES

(75) Inventors: Vishnu K. Agarwal, Boise, ID (US); Scott G. Meikle, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 9 days.

This patent is subject to a terminal disclaimer.

(21) Appl. No.: 09/970,100

(22) Filed: Oct. 2, 2001

(65) Prior Publication Data

US 2002/0018848 A1 Feb. 14, 2002

Related U.S. Application Data

(60) Continuation of application No. 09/621,021, filed on Jul. 21, 2000, now Pat. No. 6,361,832, which is a division of application No. 09/201,576, filed on Nov. 30, 1998, now Pat. No. 6,206,759.

(51) Int. Cl.[7] ..... B05D 1/36; B24D 11/00

(52) U.S. Cl. ..... 427/203; 427/419.1; 51/295; 51/309

(58) Field of Search ..... 427/430.1, 419.1, 427/203; 51/295, 309; 451/28, 526; 438/959

(56) References Cited

U.S. PATENT DOCUMENTS 3,508,890 A * 4/1970 Fontanella ..... 428/621
4,242,373 A * 12/1980 Watanabe et al. ..... 427/74
4,312,921 A * 1/1982 Hirai et al. ..... 428/446

(Continued)

OTHER PUBLICATIONS

Definition of "resin" from Merriam–Webster's Collegiate Dictionary, 10th Edition, © 1999 by Merriam–Webster, Inc., p. 996.*

Definition of "ceramic" from Hawley's Condensed Chemical Dictionary, 12th Edition, © 1993 by Van Nostrand Reinhold, p. 240.*

Pierson, H. O., "Handbook of Chemcial Vapor Deposition (CVD)," © 1992 by Hugh O. Pierson, pp. 225, 226, 231–234, 236–240.*

*Primary Examiner*—Bret Chen
*Assistant Examiner*—William Phillip Fletcher, III
(74) *Attorney, Agent, or Firm*—Dorsey & Whitney LLP

(57) ABSTRACT

Polishing pads used in the manufacturing of microelectronic devices, and apparatuses and methods for making and using such polishing pads. In one aspect of the invention, a polishing pad for planarizing microelectronic-device substrate assemblies has a backing member including a first surface and a second surface, a plurality of pattern elements distributed over the first surface of the backing member, and a hard cover layer over the pattern elements. The pattern elements define a plurality of contour surfaces projecting away from the first surface of the backing member. The cover layer at least substantially conforms to the contour surfaces of the pattern elements to form a plurality of hard nodules projecting away from the first surface of the backing member. The hard nodules define abrasive elements to contact and abrade material from a microelectronic-device substrate assembly. As such, the cover layer defines at least a portion of a planarizing surface of the polishing pad.

11 Claims, 4 Drawing Sheets

U.S. PATENT DOCUMENTS 4,536,195 A 8/1985 Ishikawa ..... 51/293
4,547,998 A * 10/1985 Kajiyama ..... 451/541
4,992,082 A * 2/1991 Drawl et al. ..... 51/295
5,049,165 A 9/1991 Tselesin ..... 51/295
5,052,339 A 10/1991 Vakerlis et al. ..... 118/723
5,085,671 A * 2/1992 Martin et al. ..... 51/293
5,308,367 A * 5/1994 Julien ..... 51/293
5,314,843 A * 5/1994 Yu et al. ..... 438/692
5,551,959 A * 9/1996 Martin et al. ..... 51/295
5,573,844 A 11/1996 Donovan et al. ..... 428/240
5,664,990 A * 9/1997 Adams et al. ..... 451/60
5,921,856 A 7/1999 Zimmer ..... 451/539
6,069,080 A * 5/2000 James et al. ..... 438/691

* cited by examiner

POLISHING PADS AND PLANARIZING MACHINES FOR MECHANICAL OR CHEMICAL-MECHANICAL PLANARIZATION OF MICROELECTRONIC-DEVICE SUBSTRATE ASSEMBLIES, AND METHODS FOR MAKING AND USING SUCH PADS AND MACHINES

CROSS REFERENCE TO RELATED APPLICATIONS

This application is a continuation of U.S. patent application Ser. No. 09/621,021, filed Jul. 21, 2000, issued as U.S. Pat. No. 6,361,832, which is a divisional of U.S. patent application Ser. No. 09/201,576, filed Nov. 30, 1998, issued as U.S. Pat. No. 6,206,759.

TECHNICAL FIELD

The present invention relates to polishing pads for planarizing microelectronic-device substrate assemblies, and to methods for making and using such polishing pads in mechanical and/or chemical-mechanical planarization processes.

BACKGROUND OF THE INVENTION

Mechanical and chemical-mechanical planarizing processes (collectively "CMP") are used in the manufacturing of electronic devices for forming a flat surface on semiconductor wafers, field emission displays and many other microelectronic-device substrate assemblies. CMP processes generally remove material from a substrate assembly to create a highly planar surface at a precise elevation in the layers of material on the substrate assembly.

FIG. 1 schematically illustrates an existing web-format planarizing machine 10 for planarizing a substrate assembly 12. The planarizing machine 10 has a support table 14 with a top panel 16 at a workstation where an operative portion (A) of a polishing pad 40 is positioned. The top panel 16 is generally a rigid plate to provide a flat, solid surface to which a particular section of the polishing pad 40 may be secured during planarization.

The planarizing machine 10 also has a plurality of rollers to guide, position and hold the polishing pad 40 over the top panel 16. The rollers include a supply roller 20, first and second idler rollers 21*a* and 21*b*, first and second guide rollers 22*a* and 22*b*, and a take-up roller 23. The supply roller 20 carries an unused or preoperative portion of the polishing pad 40, and the take-up roller 23 carries a used or postoperative portion of the polishing pad 40. Additionally, the first idler roller 21*a* and the first guide roller 22*a* stretch the polishing pad 40 over the top panel 16 to hold the polishing pad 40 stationary during operation. A motor (not shown) drives at least one of the supply roller 20 and the take-up roller 23 to sequentially advance the polishing pad 40 across the top panel 16. As such, clean preoperative sections of the polishing pad 40 may be quickly substituted for used sections to provide a consistent surface for planarizing and/or cleaning the substrate assembly 12.

The web-format planarizing machine 10 also has a carrier assembly 30 that controls and protects the substrate assembly 12 during planarization. The carrier assembly 30 generally has a substrate holder 32 to pick up, hold and release the substrate assembly 12 at appropriate stages of the planarizing cycle. A plurality of nozzles 33 attached to the substrate holder 32 dispense a planarizing solution 44 onto a planarizing surface 42 of the polishing pad 40. The carrier assembly 30 also generally has a support gantry 34 carrying a drive assembly 35 that translates along the gantry 34. The drive assembly 35 generally has an actuator 36, a drive shaft 37 coupled to the actuator 36, and an arm 38 projecting from the drive shaft 37. The arm 38 carries the substrate holder 32 via another shaft 39 such that the drive assembly 35 orbits the substrate holder 32 about an axis B—B offset from a center point C—C the substrate assembly 12.

The polishing pad 40 and the planarizing solution 44 define a planarizing medium that mechanically and/or chemically-mechanically removes material from the surface of the substrate assembly 12. The web-format planarizing machine 10 typically uses a fixed-abrasive polishing pad in which abrasive particles are fixedly bonded to a suspension material. In fixed-abrasive applications, the planarizing solution is generally a "clean solution" without abrasive particles because the abrasive particles are fixedly distributed across the planarizing surface 42 of the polishing pad 40. In other applications, the polishing pad 40 may be a nonabrasive pad composed of a polymeric material (e.g., polyurethane), a resin, or other suitable materials without abrasive particles. The planarizing solutions 44 used with nonabrasive polishing pads are typically CMP slurries with abrasive particles and chemicals to remove material from a substrate.

To planarize the substrate assembly 12 with the planarizing machine 10, the carrier assembly 30 presses the substrate assembly 12 against the planarizing surface 42 of the polishing pad 40 in the presence of the planarizing solution 44. The drive assembly 35 then orbits the substrate holder 32 about the offset axis B—B to translate the substrate assembly 12 across the planarizing surface 42. As a result, the abrasive particles and/or the chemicals in the planarizing medium remove material from the surface of the substrate assembly 12.

CMP processes should consistently and accurately produce a uniformly planar surface on the substrate assembly 12 to enable precise fabrication of circuits and photo-patterns. During the fabrication of transistors, contacts, interconnects and other components, many substrate assemblies develop large "step heights" that create a highly topographic surface across the substrate assembly 12. To enable the fabrication of integrated circuits with high densities of components, it is necessary to produce a highly planar substrate surface at several stages of processing the substrate assembly 12 because nonplanar substrate surfaces significantly increase the difficulty of forming submicron features. For example, it is difficult to accurately focus photo-patterns to within tolerances approaching 0.1 $\mu$m on nonplanar substrate surfaces because submicron photolithographic equipment generally has a very limited depth of field. Thus, CMP processes are often used to transform a topographical substrate surface into a highly uniform, planar substrate surface.

In the competitive semiconductor industry, it is also highly desirable to have a high yield in CMP processes by quickly producing a uniformly planar surface at a desired endpoint on a substrate assembly 12. For example, when a conductive layer on a substrate assembly 12 is under-planarized in the formation of contacts or interconnects, many of these components may not be electrically isolated from one another because undesirable portions of the conductive layer may remain on the substrate assembly 12 over a dielectric layer. Additionally, when a substrate assembly 12 is over planarized, components below the desired endpoint may be damaged or completely destroyed. Thus, to provide a high yield of operable microelectronic devices, CMP processing should quickly remove material until the desired endpoint is reached.

One technique to improve the performance of CMP processing is to use fixed-abrasive pads (FAPs) with a clean planarizing solution instead of nonabrasive pads with abrasive slurries. One problem with abrasive slurries is that the slurry may not uniformly contact the face of a substrate assembly 12 because the leading edge of the substrate assembly 12 wipes the slurry off of the pad 40. As a result, more abrasive particles generally contact the edge of the substrate 12 assembly than the center, causing a center-to-edge planarizing profile. FAPs seek to resolve this problem by fixedly attaching the abrasive particles to the pad in a desired distribution. By fixing the abrasive particles to the pad instead of suspending the abrasive particles in the slurry, the center of the substrate assembly 12 contacts a large number of abrasive particles irrespective of the distribution of planarizing solution between the pad and the substrate assembly 12. Using FAPs, however, presents some drawbacks in CMP processing.

One drawback of existing FAPs is that the abrasive particles in the FAPs may not adequately planarize substrate assemblies with very small components (e.g., components with a dimension of 0.25 $\mu$m or less). Existing FAPs are typically fabricated by covering a Mylar® or polyurethane backing film with a layer of resin and abrasive particles. The resin is then cured, and the layer of cured resin and abrasive particles may be textured. The particle size distribution of the abrasive particles in FAPs should: (1) be consistent from one pad to another to provide consistent planarizing results; and (2) have small particle sizes that are generally less than the critical dimension of the smallest components to avoid producing defects and to form a very smooth surface on the substrate assembly. The particle size distribution in FAPs, however, may not be small enough to planarize very small components because individual abrasive particles may agglomerate into larger abrasive elements that have a plurality of individual particles. For example, FAPs may have abrasive particles with individual particle sizes of approximately 10–250 nm, but the individual particles may agglomerate together to form relatively large abrasive elements in the resin having a size distribution from 0.2–1.5 $\mu$m. The formation of such large abrasive elements alters the consistency of the FAPs because the extent that the particles agglomerate varies from one pad to another, or even within a single pad. Additionally, large abrasive elements may scratch the substrate assembly and produce defects, or they may damage very small components of the integrated circuitry on a substrate assembly. Thus, the agglomeration of abrasive particles into larger abrasive elements is a serious problem for fabricating very small electronic components with FAPs.

Another drawback of FAPs is that it is difficult to obtain the desired distribution of abrasive particles in the resin even when the individual abrasive particles do not form a significant number of larger abrasive elements. For example, it is generally difficult to control the distribution of the abrasive particles in the resin because the resin typically has a relatively high viscosity that inhibits uniform mixing of the abrasive particles. One particularly difficult application is producing FAPs with ceria abrasive particles because it is difficult to manufacture small ceria particles and it is difficult to uniformly mix ceria particles in a liquid. Thus, even if the abrasive particles do not agglomerate extensively, it is still difficult to obtain a desired distribution of abrasive particles at the planarizing surface of an FAP.

Still another concern of using FAPs is that these pads are relatively expensive and may wear out rather quickly. FAPs are relatively expensive because of the difficulties in obtaining sufficiently small particle sizes and a desired distribution of the abrasive particles, as explained above. Moreover, FAPs are subject to wear because the substrate assembly rubs against the resin at the planarizing surface causing the resin to wear down. As a result, some of the abrasive particles may detach from the resin and cause defects, or the abrasiveness of the pad may be sufficiently altered to produce inconsistent planarizing results. Therefore, using FAPs may increase the costs of planarizing microelectronic-device substrate assemblies.

SUMMARY OF THE INVENTION

The present invention is directed toward polishing pads used in the manufacturing of microelectronic devices, and apparatuses and methods for making and using such polishing pads. In one aspect of the invention, a polishing pad for planarizing microelectronic-device substrate assemblies has a backing member including a first surface and a second surface, a plurality of pattern elements distributed over the first surface of the backing member, and a hard cover layer over the pattern elements. The pattern elements define a plurality of contour surfaces projecting away from the first surface of the backing member. The backing member and the pattern elements can accordingly define a base section having a first surface, a plurality of contour surfaces above the first surface, and a second surface configured to be placed on a planarizing machine.

The cover layer at least substantially conforms to the contour surfaces of the pattern elements to form a plurality of hard nodules projecting away from the first surface of the backing member. The hard nodules define abrasive elements to contact and abrade material from a microelectronic-device substrate assembly. As such, the cover layer defines at least a portion of a planarizing surface of the polishing pad.

The pattern elements are preferably colloidal silica particles that can be manufactured in precise sizes and shapes. The pattern elements preferably have particle sizes from approximately 5–500 nm, and more preferably from approximately 10–120 nm. The cover layer preferably is composed of an abrasive layer of material deposited over the pattern elements. For example, the abrasive layer can be composed of silica nitride, ceria, silica, alumina, titania, titanium, zirconium or nitride.

In another aspect of the invention, a polishing pad is manufactured by depositing a plurality of pattern elements over the first surface of the backing member, and then depositing the hard cover layer over the pattern elements. For example, the pattern elements can be deposited onto the first surface of the backing member by pulling the backing member through a bath having a liquid and a plurality of the pattern elements suspended in the liquid. The pattern elements are preferably colloidal in the liquid. The backing member is then removed from the bath to evaporate the liquid from the backing member and leave a plurality of the pattern elements distributed over the first surface of the backing member. The hard cover layer can then be deposited over the pattern elements using chemical vapor deposition, plasma vapor deposition or other suitable deposition processes for forming thin films on a surface.

In still another aspect of the invention, a microelectronic-device substrate assembly may be planarized using such a polishing pad by depositing a planarizing solution onto the polishing pad and pressing the substrate assembly against the hard nodules at the planarizing surface. The method continues by moving at least one of the substrate assembly and the polishing pad with respect to the other to rub the face of the substrate assembly across the nodules in the presence of the planarizing solution. The hard nodules accordingly abrade material from the face of the substrate assembly in a manner similar to abrasive particles in a fixed-abrasive pad.

DETAILED DESCRIPTION OF THE INVENTION

The present disclosure describes polishing pads for planarizing microelectronic-device substrate assemblies, methods for making such polishing pads, and machines and methods for using such polishing pads. Many specific details of certain embodiments of the invention are set forth in the following description and in FIGS. 2–8 to provide a thorough understanding of such embodiments. One skilled in the art, however, will understand that the present invention may have additional embodiments, or that the invention may be practiced without several of the details described in the following description.

Figure 2:
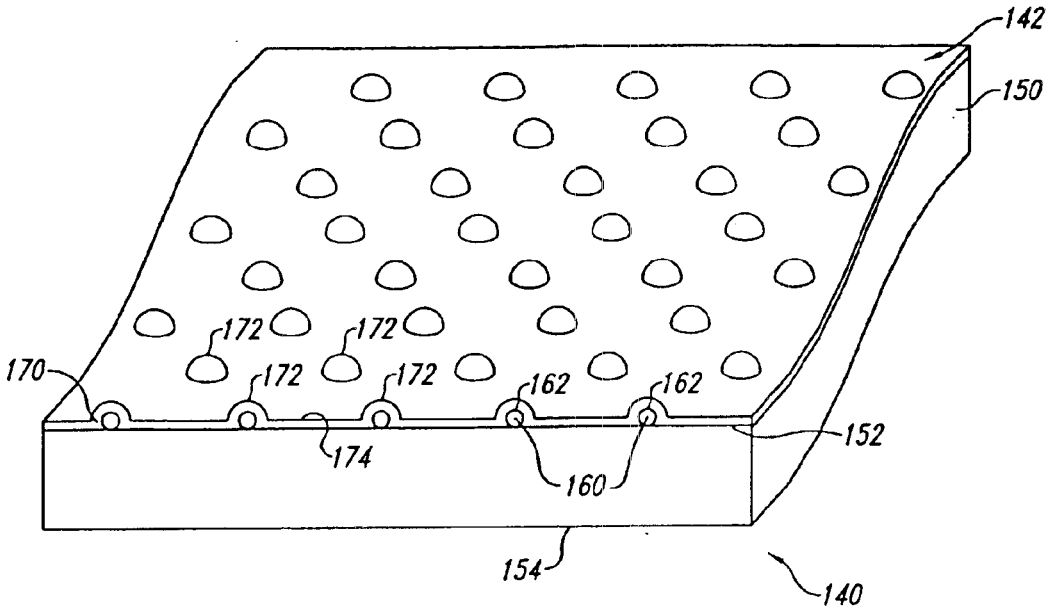
FIG. 2 is a partial schematic isometric view of a polishing pad for planarizing microelectronic-device substrate assemblies in accordance with one embodiment of the invention.

FIG. 2 is a partial schematic isometric view of a polishing pad 140 in accordance with one embodiment of the invention for planarizing microelectronic-device substrate assemblies. The polishing pad 140 includes a backing member 150 having a first surface 152 and a second surface 154, a plurality of pattern elements 160 distributed over the first surface 152 of the backing member 150, and a cover layer 170 over the pattern elements 160 and the backing member 150. As explained in more detail below, the pattern elements 160 and the cover layer 170 operate together to form an abrasive planarizing surface 142 that has characteristics similar to fixed-abrasive polishing pads.

In the embodiment of the polishing pad 140 shown in FIG. 2, the pattern elements 160 are deposited or otherwise distributed directly on the first surface 152 of the backing member 150. The pattern elements 160 define a plurality of contour surfaces 162 projecting away from the first surface 152. The cover layer 170 is preferably a hard, rigid layer over the pattern elements 160. The cover layer 170 at least substantially conforms to the contour surfaces 162 of the pattern elements 160 to form a plurality of hard nodules 172 defining abrasive elements projecting away from the first surface 152 of the backing member 150. When the pattern elements 160 are spaced apart from one another (as shown in FIG. 2), the cover layer 170 also preferably conforms to the exposed portions of the first surface 152 to form a low region 174 between the hard nodules 172. The pattern elements 160 can alternatively cover the first surface 152 of the backing member 150; in which case the cover layer 170 conforms to the contiguous contour surfaces 162 of the pattern elements. The cover layer 170 accordingly defines at least a portion of a planarizing surface 142 of the polishing pad 140 for engaging a microelectronic-device substrate assembly during planarization. As set forth in more detail below, the materials and configuration of the backing member 150, the pattern elements 160 and the cover layer 170 are selected to provide the desired hardness, abrasiveness and particle distribution for particular CMP applications.

The backing member 150 can be a continuous web for being wrapped around a roller of a web-format machine, or the backing member 150 can be cut into a circle for attachment to a platen of a rotary planarizing machine. The backing member 150 is generally about 0.050 inches thick, but the backing member can have other thicknesses according to the particular application. In one embodiment, the backing member 150 is composed of a compressible polymeric material. Suitable compressible polymeric materials include polyurethanes, such as the polyurethanes used in the IC-60 polishing pad, die IC-1000 polishing pad and other polishing pads manufactured by Rodel Corporation of Newark, Del. In another embodiment, the backing member 150 can be composed of a cured resin to be relatively incompressible. In still another embodiment, the backing member 150 is composed of Mylar® manufactured by E.I. du Pont de Nemours & Co.

The pattern elements 160 can be composed of many different types of materials, and they can have many different sizes and shapes. Suitable materials for the pattern elements 160 include, at least in part, colloidal silica particles, organic polymers (e.g., latex particles), and/or other types of small particles. The pattern elements are preferably made from a material that can be manipulated to produce small particles that do not readily agglomerate and can be deposited onto the backing member 150 in a controlled, desired distribution. The pattern elements 160 can accordingly be nonabrasive elements or they can be abrasive particles. The pattern elements 160 generally have particle sizes from approximately 5–500 nm, and preferably from approximately 10–200 nm, and more preferably from approximately 10–120 nm. The pattern elements 160 can also have many different shapes, including spherical, cylindrical, pyramidal or other geometric shapes. In one particular embodiment, the pattern elements 160 are substantially spherical colloidal silica particles that have particle sizes of approximately 10–120 nm.

The cover layer 170 is preferably composed of a hard material that can abrade the surface of a microelectronic-device substrate assembly during planarization. The cover layer 170, for example, can be a thin layer composed of silica nitride, ceria, silica, alumina, titanium nitride, titania, zirconia or other suitable metallic or ceramic materials. The cover layer 170 is generally selected to provide the correct abrasiveness to the planarizing surface 142 of the polishing pad 140. In general, the cover layer 170 is formed by depositing the appropriate material using chemical vapor deposition, plasma vapor deposition, or other processes known in the semiconductor fabrication arts for forming thin, conformal layers. The thickness of the cover layer 170 is selected to provide the desired topography of the nodules 172. For example, when the pattern elements 160 have a size of approximately 50–100 nm, the cover layer is approximately 300–600 Å thick.

Figure 3:
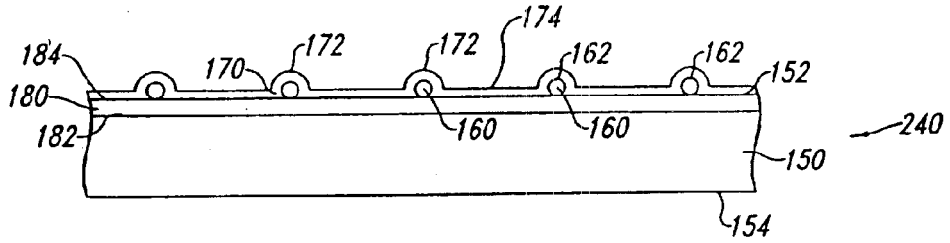
FIG. 3 is a partial schematic cross-sectional view of a polishing pad for planarizing microelectronic-device substrate assemblies in accordance with another embodiment of the invention.

FIG. 3 is a partial schematic cross-sectional view of a polishing pad 240 in accordance with another embodiment of the invention. The polishing pad 240 has an intermediate layer 180 between the backing member 150 and the pattern elements 160. More particularly, the intermediate layer 180 has a lower surface 182 directly on the first surface 152 of the backing member 150 and an upper surface 184 over the first surface 152. The pattern elements 160 are distributed directly on the upper surface 184 of the intermediate layer 180 over the first surface 152 of the backing member 150. When the pattern elements 160 are spaced apart from one another, the cover layer 170 accordingly conforms to the contour surfaces 162 of the pattern elements 160 and the upper surface 184 of the intermediate layer 180.

The intermediate layer 180 is preferably composed of a ceramic material or metal material that provides a hard, rigid support surface for the pattern elements 160 and the cover layer 170. The intermediate layer 180 can also be selected from a material that adheres well to the backing member 150 and the cover layer 170. Suitable materials for the intermediate layer 180 include, at least in part, silica nitride, ceria, silica, alumina, titanium nitride, titania, zirconia or other suitable metallic or ceramic materials.

Figure 1:
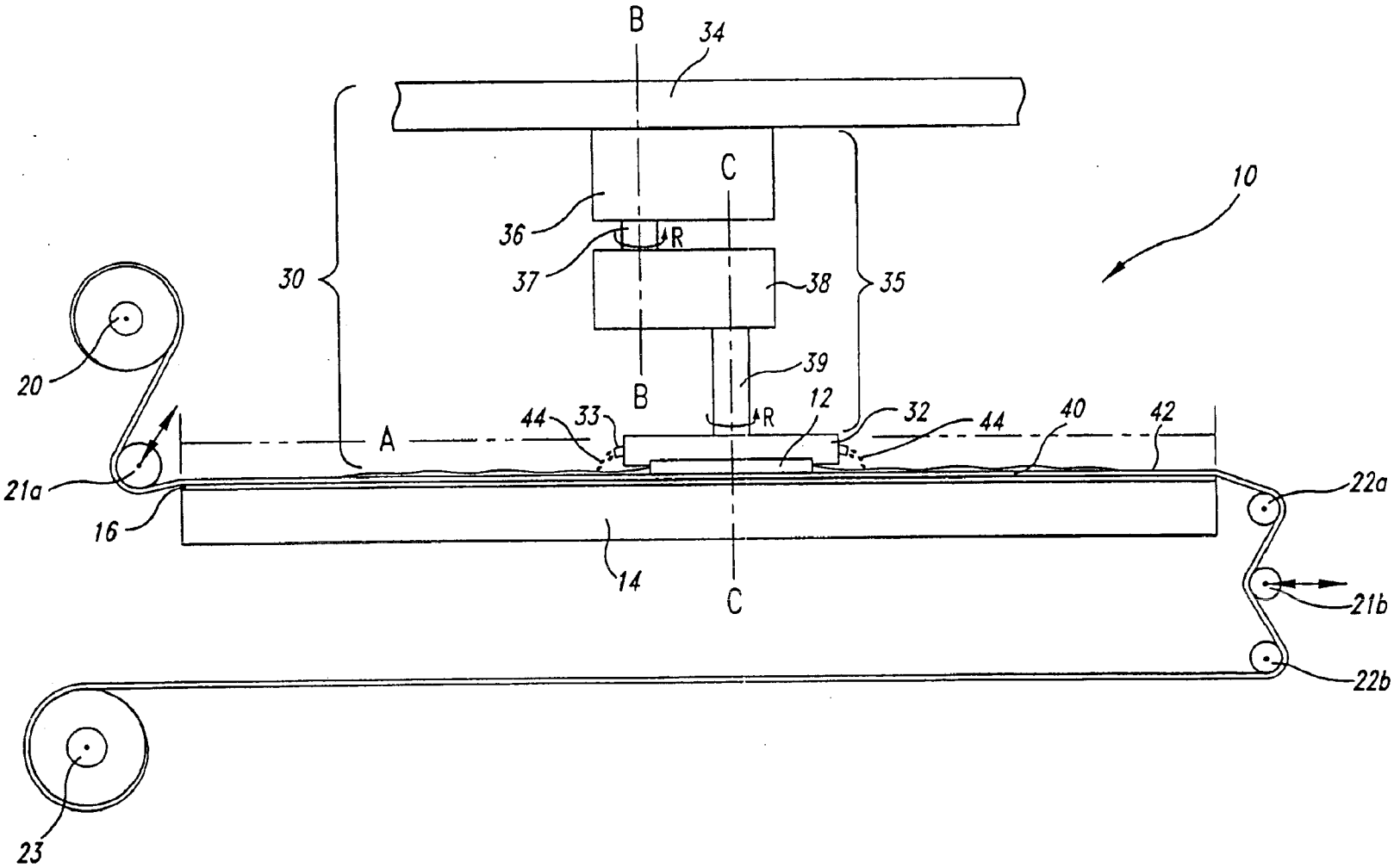
Fig. 1 (PRIOR ART)
FIG. 1 is a schematic side elevational view of a web-format planarizing machine in accordance with the prior art.
Figure 4:
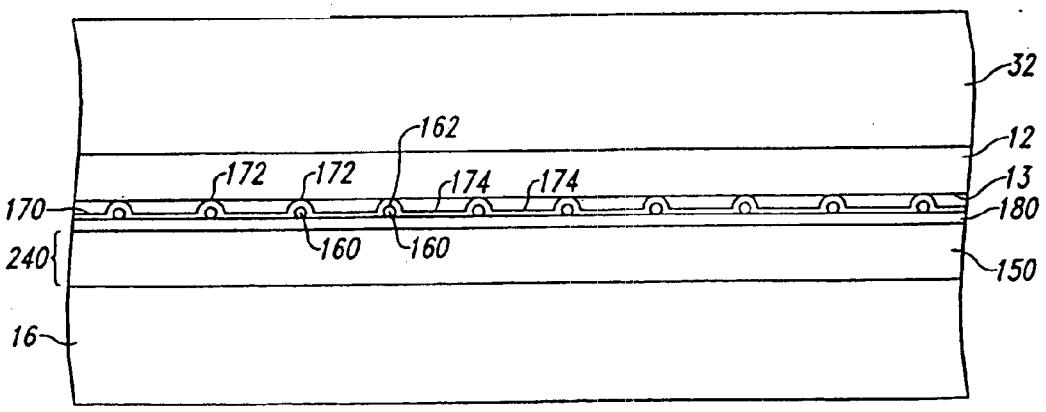
FIG. 4 is a partial schematic cross-sectional view of a microelectronic-device substrate assembly being planarized on the polishing pad of FIG. 3.

FIG. 4 is a partial schematic cross-sectional view of a microelectronic-device substrate assembly 12 being planarized with the polishing pad 240 described above with reference to FIG. 3. The substrate assembly 12 can be mounted to a substrate holder 32 similar to that shown in FIG. 1. The substrate holder 32 presses a front face 13 of the substrate assembly 12 against the nodules 172 of the polishing pad 240. At least one of the substrate holder 32 or the polishing pad 240 moves relative to the other in the plane of the polishing pad 240 to move the front face 13 of the substrate assembly 12 across the nodules 172. More particularly, only the substrate holder 32 preferably moves in applications using web-format planarizing machines; both the substrate holder 32 and the table move in applications using rotary planarizing machines. The substrate holder 32 also preferably dispenses a planarizing solution (see Reference Nos. 33 and 44 of FIG. 1) onto the polishing pad 240. The polishing pad 240 abrasively removes material from the front face 13 of the substrate assembly 12 because the cover layer 170 is a hard material and the nodules 172 projecting above the low regions 174 are effectively very small abrasive particles. Additionally, the chemicals in the planarizing solution can also remove material from the front face 13 of the substrate assembly 12.

The particular embodiments of the polishing pads 140 and 240 described above are expected to be particularly well-suited for planarizing substrate assemblies having extremely small components. One aspect of the polishing pads 140 and 240 is that the nodules 172 can be very small abrasive elements composed of materials that are generally difficult to control in particulate form. The nodules 172 can be constructed in very small sizes because the pattern elements can be selected from a material that: (1) does not readily agglomerate; (2) can be formed in very small particle sizes; and (3) can have particles with desired shapes. The pattern elements 160, for example, can be spherical colloidal silica particles. The nodules 172 are also small because the cover layer 170 can be a very thin conformal layer of material. The cover layer 170, moreover, can be composed of a desired abrasive material that is normally subject to agglomerating in particulate form, such as ceria. For example, instead of using ceria abrasive particles that easily agglomerate and do not provide sufficiently small abrasive particle sizes in a desired distribution on a fixed-abrasive pad, one particular embodiment of the invention uses colloidal silica pattern elements to form a desired pattern of raised features across the backing member and then covers the silica pattern elements with a thin layer of ceria to form extremely small well-defined ceria abrasive elements. Thus, several embodiments of the polishing pads provide very small abrasive nodules that should be well-suited for planarizing substrate assemblies having small components.

The particular embodiments of the polishing pads 140 and 240 described above are also expected to provide wear-resistant pads that have a long operating life. Existing fixed-abrasive pads are subject to wear because the resin binder that holds the abrasive particles may deteriorate or otherwise wear down as the front face of the substrate assembly grinds against the abrasive surface and the chemicals in the planarizing solution react with the resin. Unlike existing fixed-abrasive pads, the hard cover layer 170 preferably completely covers the pads 140 and 240 to provide a hard, wear resistant layer across the planarizing surface. The cover layer 170 is expected to be less susceptible to mechanical and chemical wear than the resin binder in existing pads. Therefore, compared to existing fixed-abrasive pads, the embodiments of the pads 140 and 240 shown above are expected to have better wear characteristics.

Figure 5:
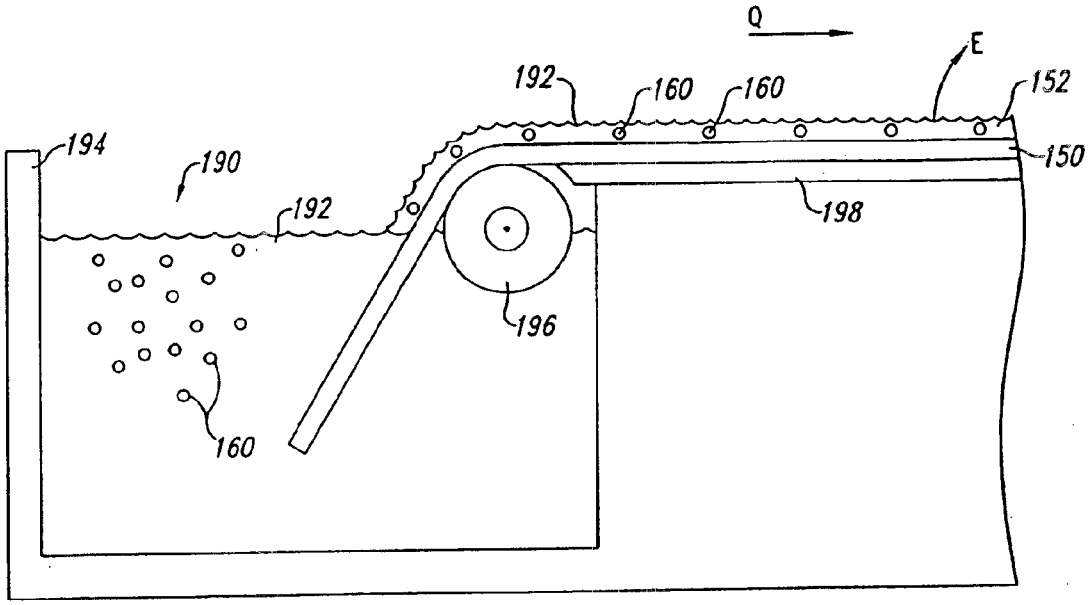
FIG. 5 is a partial schematic cross-sectional view of a stage of a method for manufacturing a polishing pad in accordance with an embodiment of the invention.

The polishing pads in accordance with the invention can be manufactured according to several different methods. FIG. 5 is a schematic cross-sectional view of one stage in a method for manufacturing the polishing pad 140 (FIG. 2) described above. In this method, the backing member 150 is drawn through a bath 190 having a fluid 192 and a plurality of the pattern elements 160 dispersed in the fluid 192. The bath 190, for example, can be contained in a tank 194 having a roller 196 and a platform 198. The backing member 150 more particularly, moves through the tank 194 and across the platform 198 (arrow Q) to coat the first surface 152 of the backing member 150 with a thin layer of the fluid 192 and the pattern elements 160. The fluid 192 then evaporates, leaving a distribution of the pattern elements 160 over the first surface 152 of the backing member 150. The distribution and density of the pattern elements 160 over the first surface 152 is controlled by selecting the concentration of the pattern elements 160 in the bath 190. After the fluid 192 evaporates from the backing member 150, the cover layer 170 (FIGS. 2 and 3) is then formed -over the backing member 150 and the pattern elements 160 to create the nodules 172 (FIGS. 2 and 3). The cover layer 170 is preferably formed by depositing the cover layer material using plasma vapor deposition or chemical vapor deposition techniques known to those skilled in the arts of fabricating semiconductor devices.

Figure 6:
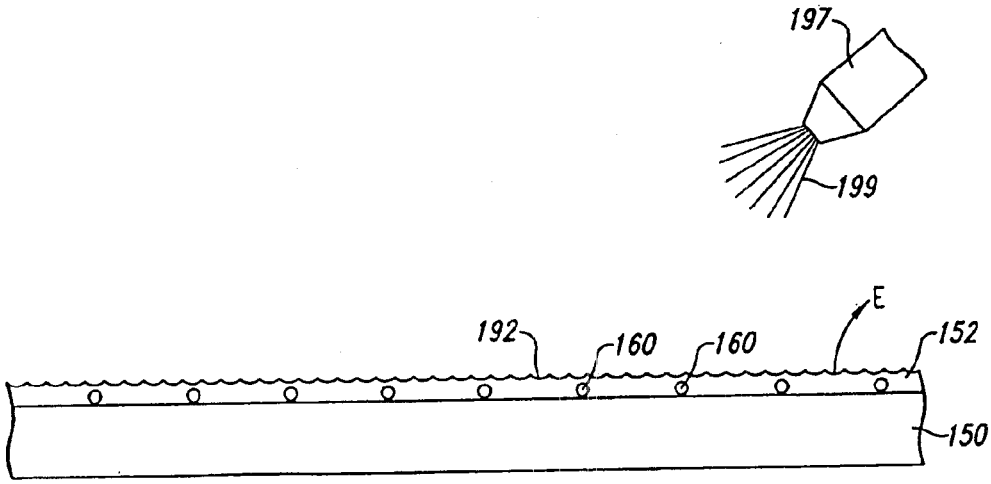
FIG. 6 is a partial schematic cross-sectional view of a stage of a method for fabricating a polishing pad in accordance with another embodiment of the invention.

FIG. 6 is a schematic cross-sectional view illustrating a stage of another method for fabricating polishing pads in accordance with the invention. In this particular embodiment, a nozzle 197 sprays a solution 199 onto the first surface 152 of the backing member 150. The solution 199 generally contains the fluid 192 and the pattern elements 160. Accordingly, this embodiment also coats the first surface 152 of the backing member 150 with a layer of the fluid 192 and the pattern elements 160. As set forth above, the fluid 192 evaporates from the backing member 150, leaving a distribution of pattern elements 160 over the backing member, and then the cover layer 170 is formed over the pattern elements 160 and the backing member 150.

One particular advantage of spraying the solution onto the backing member 150 is that the distribution of the pattern elements 160 can be varied in different regions of the polishing pad. For example, a first solution having a first concentration and/or a first type of pattern element 160 can be sprayed onto a first region of the backing member 150, and a second solution having a second concentration and/or a second type of pattern element 160 can be sprayed onto a second region of the backing member 150. Alternatively, after the liquid of the solution 199 evaporates, the nozzle 197 can spray subsequent coatings of solution 199 over selected regions of the backing member 150 to add more pattern elements 160 to such regions without removing the pattern elements 160 previously deposited onto the backing member 150.

The particular embodiments of the methods described above with reference to FIGS. 5 and 6 are expected to provide a controlled distribution of very small particle sizes across the planarizing surface of polishing pads in accordance with the invention. One aspect of these methods is that the density and/or distribution of the pattern elements 160 over the first surface 152. of the backing member 150 can be closely controlled by selecting the appropriate concentration of the pattern elements 160 in the bath 190 or the sprayed solution 199. Additionally, as explained above the particle sizes of the pattern elements 160 can be extremely small. Therefore, several embodiments of methods in accordance with the invention are expected to provide a controlled distribution of very small pattern elements across the surface of the polishing pad.

Another aspect of the methods described above with respect to FIGS. 5 and 6 is that they are relatively simple compared to conventional methods for forming fixed-abrasive pads. As described above, existing fixed-abrasive pads can be difficult to manufacture because it is difficult to accurately distribute small abrasive particles in the resin binder of such pads. In contrast to existing fixed-abrasive pads, the pattern elements 160 are distributed across the backing member 150 by simply coating the backing member 150 with a layer of pattern elements 160 in an evaporable fluid. The abrasive nodules 172 are then constructed by forming the abrasive cover layer over the pattern elements 160 with processes that are commonly used to form thin films on substrates in semiconductor manufacturing arts. Therefore, the embodiments of the methods described above with reference to FIGS. 5 and 6 are expected to provide easy and cost effective processes for manufacturing polishing pads in accordance with the invention.

Figure 7:
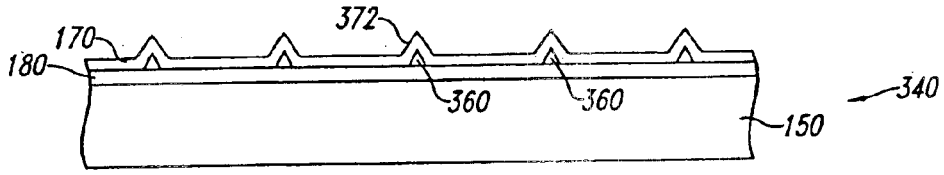
FIG. 7 is a partial schematic cross-sectional view of another polishing pad for planarizing microelectronic-device substrate assemblies in accordance with yet another embodiment of the invention.

In addition to the polishing pads described above with reference to FIGS. 2–4, there may be other embodiments of polishing pads in accordance with the invention. For example, FIG. 7 is a schematic partial cross-sectional view of a polishing pad 340 in accordance with another embodiment of the invention. The polishing pad 340 is similar to the polishing pad 240 shown in FIG. 3, and thus like reference numbers refer to like parts. For example, the polishing pad 340 can include a backing member 150, an intermediate layer 180 directly on the backing member 150, and a hard cover layer 170 over the intermediate layer 180. The polishing pad 340 also includes a plurality of pattern elements 360 that are pyramidal or another type of shape. The pyramidal pattern elements 360 are expected to form nodules 372 that have different abrasive characteristics than the spherical pattern elements 160 shown in FIGS. 2–4. Accordingly, the pattern elements of the polishing pads in accordance with the invention can be selected to have a shape that imparts the desired abrasiveness to the polishing pads.

Figure 8:
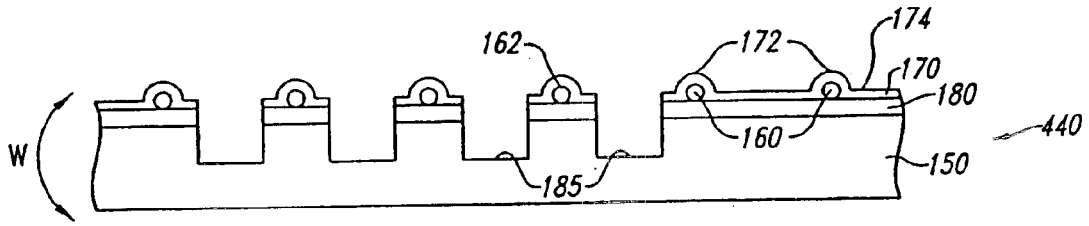
FIG. 8 is a partial schematic cross-sectional view of another polishing pad for planarizing microelectronic-device substrate assemblies in accordance with still another embodiment of the invention.

FIG. 8 is a schematic partial cross-sectional view of another polishing pad 440 in accordance with still another embodiment of the invention. The polishing pad 440 is also similar to the polishing pad 240 described above with reference to FIG. 3, and thus like reference numbers refer to like parts. The polishing pad 440 has a plurality of grooves 185 through the cover layer 170, the intermediate layer 180 and a portion of the backing member 150. The grooves 185 can be configured to provide channels for transporting a planarizing solution (not shown) under a substrate (not shown). The grooves 185 can also be configured to allow the polishing pad 440 to be flexed (arrow W) so that the polishing pad 440 can be wrapped around a roller of a web-format planarizing machine (FIG. 1) without cracking the thin abrasive cover layer 170 or the rigid intermediate layer 180. For example, to provide sufficient flexibility to a webformat pad, the grooves 185 preferably extend across the width of the pad normal to a longitudinal axis along the length of the pad. Additionally, the backing member 150 of a web-format pad is preferably composed of a flexible material to provide more flexibility for the pad 440. The grooves 185 generally have a depth between 2–200 $\mu$m, a width of between 20–500 $\mu$m, and a pitch (distance between grooves) of between 200–1000 $\mu$m. In one particular embodiment, the grooves have a depth of 20 $\mu$m, a width of 100 $\mu$m, and a pitch of approximately 400 $\mu$m. The grooves 185 may also have other dimensions outside of these ranges. The grooves 185 are preferably formed by photo-patterning the cover layer 170 with a resist, washing a portion of the resist away, and etching the grooves 185 into the pad 440. Suitable photo-patterning and etching processes are known to those skilled in the art of semiconductor processing.

From the foregoing it will be appreciated that, although specific embodiments of the invention have been described herein for purposes of illustration, various modifications may be made without deviating from the spirit and scope of the invention. For example, the backing member 150 and any types of features having contour surfaces projecting away from the backing member can define a base section upon which the cover layer can be formed to construct the nodules. The contour surfaces can accordingly be features formed from the backing member 150 by photo-patterning and etching the backing member to form pattern elements that are integral with the backing member. As such, the pattern elements are not necessarily separate particles or other types of features that are separate from the backing member. Accordingly, the invention is not limited except as by the appended claims.

What is claimed is:

1. A method of manufacturing a polishing pad for planarization of a microelectronic-device substrate assembly, comprising:

depositing an intermediate layer comprised of a material selected from the group consisting of: silica nitride, ceria, silica, alumina, titania, titanium nitride, a ceramic material or a metallic material, over a first layer of a polymeric material, depositing a plurality of pattern elements over an upper surface of the intermediate layer, each pattern element directly contacting the upper surface of e intermediate layer and having a portion projecting away from the first layer of the polymeiic material thereby forming a contour surface projecting away from the intermediate layer; and covering the contour surfaces with a hard cover layer comprising a material selected from the group consisting of: silica nitride, ceria, silica, alumina, titanic nitride, titania, titanium, zirconia, a nitride and a ceramic, that contacts portions of the upper surface of the intermediate layer and conforms to the contour surfaces to form nodules from the portions of the hard cover layer over the contour surfaces, the nodules projecting away from the upper surface of the intermediate layer and the first layer of polymeric material.

2. The method of claim 1, wherein the intermediate layer is comprised of silica nitride.

3. The method of claim 1, wherein the intermediate layer is comprised of ceria.

4. The method of claim 1, wherein the intermediate layer is comprised of silica.

5. The method of claim 1, wherein the intermediate layer is comprised of alumina.

6. The method of claim 1, wherein the intermediate layer is comprised of titanium nitride.

7. The method of claim 1, wherein the intermediate layer is comprised of titania.

8. The method of claim 1, wherein the intermediate layer is comprised of titanium.

9. The method of claim 1, wherein the intermediate layer is comprised of zirconia.

10. The method of claim 1, wherein the intermediate layer is a metallic layer.

11. The method of claim 1, wherein the intermediate layer is a ceramic layer.

* * * * *